US007988085B2

(12) United States Patent
Cattacin et al.

(10) Patent No.: US 7,988,085 B2
(45) Date of Patent: Aug. 2, 2011

(54) SYSTEM FOR DISPENSING PAPER IN ROLL FORM, METHOD OF MANUFACTURING SUCH A ROLL, AND ROLL OF PAPER

(75) Inventors: Gilles Cattacin, Colmar (FR); Jean-Louis Jehl, Artolsheim (FR); Nicolas Pommier, Colmar (FR)

(73) Assignee: Georgia-Pacific France (FR)

( * ) Notice: Subject to any disclaimer, the term of this patent is extended or adjusted under 35 U.S.C. 154(b) by 0 days.

(21) Appl. No.: 12/340,271

(22) Filed: Dec. 19, 2008

(65) Prior Publication Data

US 2009/0159735 A1 Jun. 25, 2009

(30) Foreign Application Priority Data

Dec. 24, 2007 (FR) ..... 07 60333

(51) Int. Cl.
*B65H 16/06* (2006.01)

(52) U.S. Cl. ..... 242/596.7; 242/596.8; 242/599.4

(58) Field of Classification Search ..... 242/596.7, 242/596.8, 599.3, 599.4, 596.5, 588.6, 596, 242/590, 570; 312/34.8
See application file for complete search history.

(56) References Cited

U.S. PATENT DOCUMENTS

| | | | | |
|---|---|---|---|---|
| 3,584,817 | A * | 6/1971 | Bolger | 242/596.4 |
| 4,762,288 | A * | 8/1988 | Eckels | 242/422.4 |
| 5,495,997 | A | 3/1996 | Moody | |
| 5,794,882 | A | 8/1998 | Lewis | |
| 7,066,423 | B2 * | 6/2006 | Andersson | 242/599.3 |
| 7,513,453 | B2 * | 4/2009 | Cattacin et al. | 242/596.7 |
| 7,648,097 | B2 * | 1/2010 | Cattacin et al. | 242/560 |
| 2004/0129825 | A1 * | 7/2004 | Andersson | 242/570 |
| 2005/0139721 | A1 * | 6/2005 | Andersson | 242/599.4 |
| 2007/0114321 | A1 * | 5/2007 | Cattacin et al. | 242/596 |

FOREIGN PATENT DOCUMENTS

| | | | |
|---|---|---|---|
| EP | 1782722 | A1 | 5/2007 |
| WO | 2005/094653 | A1 | 10/2005 |
| WO | 2007/146516 | A1 | 12/2007 |

OTHER PUBLICATIONS

French Search Report and Written Opinion dated Aug. 14, 2008, for French Patent Application No. 0760333 filed Dec. 24, 2007.

* cited by examiner

*Primary Examiner* — Michael R Mansen
*Assistant Examiner* — Juan J Campos

(57) ABSTRACT

A system for dispensing a strip of absorbent product in the form of a roll, of the type comprising a roll, formed of a wound strip of absorbent product, axially delimited by a first lateral side and a second lateral side, a dispenser for dispensing the absorbent product in the form of a roll, of the type comprising a frame and a cover which is mounted such that it can move, means for holding and guiding the rotation of the roll with respect to the frame, which means comprise a first holding element for holding the roll and which is borne by the frame, and a second guiding and positioning element which is borne by the cover such that it is fixed in terms of rotation and which can be housed axially in a lateral housing of the roll, characterized in that the second guiding and positioning element comprises at least one projecting portion on which an internal wall of the second housing is able to slide for guiding the rotation of the roll if the roll is a complementary roll, and which is able to dig into the strip of product of which the roll is formed if the roll is not a complementary roll so as to prevent it from rotating.

7 Claims, 3 Drawing Sheets

SYSTEM FOR DISPENSING PAPER IN ROLL FORM, METHOD OF MANUFACTURING SUCH A ROLL, AND ROLL OF PAPER

CROSS REFERENCE TO RELATED APPLICATIONS

This application claims priority to copending French patent application number 07 60333, filed Dec. 24, 2007, the disclosure of which is incorporated herein by reference in its entirety.

BACKGROUND OF THE INVENTION

The invention relates to a system for dispensing paper in roll form and to the method of manufacturing such a roll.

The invention relates more specifically to a system for dispensing a strip of absorbent product in the form of a roll, through rotation of the roll about an axis, of the type comprising:

- a roll, formed of a wound strip of absorbent product, of substantially cylindrical shape, and axially delimited by a first lateral side and a second axially opposed lateral side;
- a dispenser for dispensing the absorbent product in the form of a roll, of the type comprising a frame and a cover which is mounted such that it can move with respect to the frame, between an open position that allows the roll to be fitted inside the dispenser and a closed position for use of the roll;
- means for holding and guiding the rotation of the roll with respect to the frame, which means comprise:
  - a first holding element which is borne by the frame and which is able to be received axially in a first lateral housing arranged in the first side of the roll, and
  - a second guiding and positioning element which is borne by the cover such that it is fixed in terms of rotation and which can be received axially in a second lateral housing arranged in the second side of the roll.

Numerous examples of dispensing systems of this type are known.

These are, for the most part, systems which dispense one-use paper, particularly for the general public and for away from home use, known by the name of bathroom tissue, cleaning roll, kitchen towel or towel paper.

To ensure the quality of the dispensed product, some manufacturers have developed so-called "captive" systems which can accept only one type of product or a specified group of products.

There are different ways for making the system "captive".

In particular, the prior art includes specially shaped plastic end caps, which are positioned, for example, inside a core on which the product is wound and which interact with complementary supports positioned inside the dispenser. Without these end caps, the roll cannot be put in place or cannot be used correctly.

The main drawback of this type of device is an economic one: it is necessary to manufacture additional components which are not of great benefit to the user of the system and which cannot be used once the roll is finished. These plastic components therefore represent an additional cost and increased waste when the roll is finished.

There are also known rolls including sides provided with a groove, each interacting with a special support: an ungrooved roll cannot be held in the dispenser or, alternatively, the cover of this dispenser cannot be closed because of the difference in overall dimensions between the roll without a groove and a roll with grooves.

This type of system is efficient but the manufacture of these apertures requires complex installations for converting the rolls.

To overcome this drawback, document EP-A1-1 782 722 proposes a dispensing system which comprises a strip of absorbent product in roll form and a dispenser.

The dispenser comprises a frame and a cover which is mounted to be movable with respect to the frame, between an open position that allows the roll to be fitted inside the dispenser and a closed position for the use of the roll.

The dispenser comprises a first guiding and positioning element which is borne by the cover and which can be received axially in a first housing positioned in the centre of a first side of the roll, and a second holding element which is borne by the frame and which can be received axially in a second housing positioned in the centre of a second side of the roll.

The first guiding and positioning element comprises a smooth section that is substantially frustoconical, its cross section decreasing towards the inside of the dispenser and which can be housed axially in the first associated housing of the roll.

According to that system, a roll that has no housing of frustoconical shape to complement the shape of the smooth section will prevent the cover of the dispenser from being closed because of the difference in overall dimensions between the roll without a complementary housing and a roll with a frustoconical complementary housing.

However, the smooth section can be forcibly driven into the side of the roll that has no complementary housing, by forcing the cover closed in such a way as to deform the side of the roll.

In spite of the friction between the side of the roll deformed in this way and the smooth section, there is a risk that the roll may be able to rotate about its axis of rotation by sliding on the smooth section, and that the system will then be useable, in spite of degraded operating conditions.

BRIEF DESCRIPTION OF THE INVENTION

To remedy the above noted disadvantages the invention proposes an economical means of making the "dispenser/roll of paper" system into a captive one without adding further elements to the roll.

In addition, the invention proposes a dispensing system that comprises opposing means for the rotation of a roll that does not have a complementary housing.

To this end, the invention proposes a system of the aforementioned type, characterized in that the second guiding and positioning element comprises at least one projecting portion on which an internal wall of the second housing is able to slide for guiding the rotation of the roll if the roll has a complementary shape, and which is able to dig into the strip of product of which the roll is formed if the roll does not have a complementary shape so as to prevent it from rotating.

According to other features of the system:

the projecting portion comprises at least one plate with an external leading edge, at least partially substantially parallel to the internal wall of the second housing, so that the internal wall of the second housing is able to slide in rotation on the edge of the plate if the roll is a complementary roll;

the leading edge of the plate is of convex shape to encourage sliding on the internal wall of the second housing of the complementary roll;

the plate comprises at least one notch which extends axially from the leading edge of the plate and is able to trap a core of a non-complementary roll;

the projecting portion comprises a plurality of plates extending radially, axially and symmetrically about the axis of rotation of the roll with uniform angular spacings;

each plate is of a cross section that decreases towards the inside of the dispenser so that the leading edge of each plate is angled towards the axis of rotation of the roll.

The invention also relates to a method of manufacturing a roll for the dispensing system according to the invention, characterized in that it comprises a step whereby one side of the roll is axially deformed using a forming tool so as to produce the second housing which is able to collaborate with the second guiding and positioning element.

The invention also relates to a complementary roll formed of a strip of absorbent product rolled up, which is manufactured according to a method according to the invention and which is intended for the dispensing system, characterized in that the second housing of the roll is arranged at the centre of the second side of the roll and the internal wall of the second housing has a shape exhibiting symmetry of revolution about the axis of rotation of the roll.

BRIEF DESCRIPTION OF THE DRAWINGS

Other features and advantages will become apparent when reading the following detailed description, for understanding of which reference will be made to the attached drawings, among which.

DETAILED DESCRIPTION OF THE INVENTION

Figure 1:
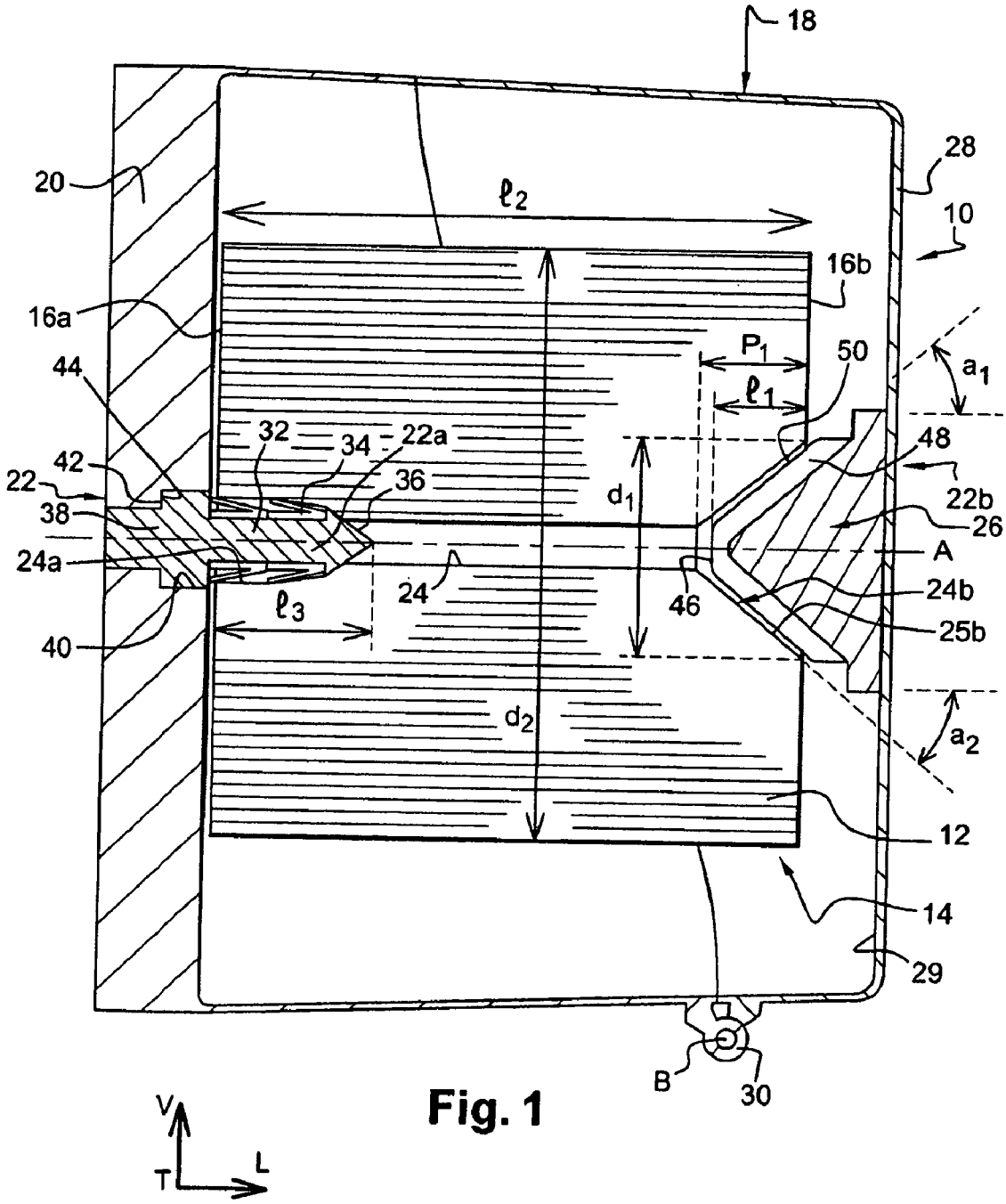
FIG. 1 is a front view in longitudinal section of the dispensing system according to the invention.

In the description which will follow, which is given by way of nonlimiting illustration, components that are identical, analogous or similar will be denoted by the same reference numerals.

In the description and in the claims, the vertical, longitudinal and transverse directions according to the trihedral frame of reference L, V, T shown on the figures are used, without restrictive intent.

FIG. 1 depicts a system 10 for dispensing a strip of absorbent product.

The absorbent product, is, for example, a strip of paper 12, such as bathroom tissue, which is in the form of a roll 14 of cylindrical shape, with axis A.

The roll 14 is axially delimited by a first side 16*a* and a second lateral side 16*b*, which sides are axially opposite each other.

Figure 3A:
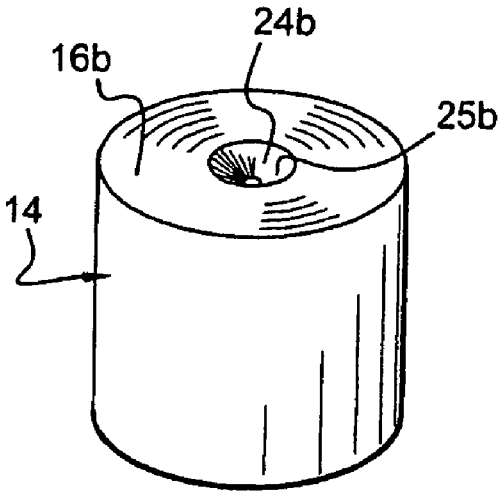
FIG. 3*a* is a perspective view of a roll of paper according to the invention, illustrating a first side comprising a housing according to one embodiment of the invention.
Figure 3B:
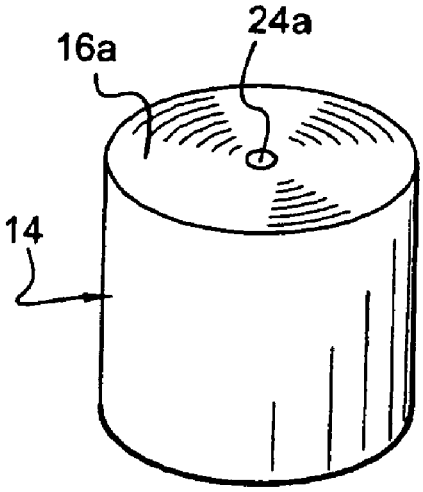
FIG. 3*b* is a view identical to FIG. 3*a*, illustrating a second side of the roll according to the invention.

The roll 14 comprises a first housing 24*a*, illustrated in FIG. 3*b*, which is positioned at the centre of the first side 16*a* of the roll 14 and which has an internal wall.

Likewise, the roll 14 comprises a second housing 24*b*, illustrated in FIG. 3*a*, which is arranged at the centre of the second side 16*b* of the roll 14 and which has an internal wall 25*b*.

The first housing 24*a* and the second housing 24*b* are axially opposed in this instance and connected to one another by a largely tubular cavity 24 which extends along the axis A of the roll 14.

The dispensing system 10 also comprises a dispenser 18 for dispensing the paper 12, which dispensing is performed by rotating the roll 14 about the axis A.

To do this, the dispenser comprises a frame 20 which, advantageously, is firmly attached to a wall (not depicted).

The dispenser 18 comprises a cover 28 which is mounted such that it can move with respect to the frame 20 via rotation means 30.

The rotation means 30 here consist of a pivot connection of the hinge type, of axis B.

Thus, the cover 28 can be opened and closed by a rotary movement about the axis B which is transverse and orthogonal to the axis A of rotation of the roll 14.

As a result, the cover 28 can occupy an open position for fitting the roll 14 and a closed position for dispensing the paper 12, this being illustrated in FIG. 1.

Without implying any limitation, the frame 20 and the cover 28 may be a single part, in which case the frame 20 and the cover 28 would, for example be connected together by a flexible portion which enables the cover 28 to be opened with respect to the frame 20.

In the known way, the dispenser 18 comprises means 22 for holding and guiding the rotation of the roll 14.

As illustrated in FIG. 1, the means 22 for holding and guiding the rotation of the roll 14 comprise a first holding element 22*a* which is borne by the frame 20 and which is able to be housed axially in the associated first housing 24*a* of the roll 14.

The first holding element 22*a* is of the "hook" type known from the prior art, and is of cylindrical overall shape.

In a first axial end, the first holding element 22*a* comprises a catching section 32 which is arranged axially along the axis A of rotation of the roll 14, in the first housing 24*a* of the first side 16*a* of the roll 14.

The catching section 32 comprises radially projecting elements 34 such as fins 34 which extend in a direction substantially at an angle to the longitudinal axis A of the roll 14 so that the fins 34 oppose the withdrawal of the first holding element 22*a* when this element is pushed into the roll 14, as illustrated in FIG. 1 for example.

The fins 34 are preferably free to rotate about the axis A with respect to the catching section 32 and the section 32 is fixed with respect to the frame 20.

In addition, the catching section 32 has a chamfer 36 to make the first holding element 22*a* easier to insert into the roll 14.

The catching section 32 of the first holding element 22*a* preferably has an axial length $l_3$ equal to or less than one third of the axial length $l_2$ of the roll 14.

In a second end, the first holding element 22*a* comprises a section 38 fixed in a bore 40 of the frame 20 along the longitudinal axis A of the roll 14.

In addition, the first holding element 22*a* has a shoulder 42 which collaborates with an annular seat 44 of the bore 40 of the frame 20 to prevent any axial movement of the first holding element 22*a* along the axis A towards the outside of the dispenser 18.

To complement this, the means 22 for holding and guiding the rotation of the roll 14 comprise a second holding element 22*b* which is borne by the moving hood 18.

The second guiding and positioning element 22*b* comprises a projecting portion 26 which extends axially from an internal face 29 of the cover 28 and which is fixed in terms of rotation.

The internal face 29 of the hood 28 is arranged facing the first side 16*a* of the roll 14 when the cover 28 is in its closed position, such that the projecting portion 26 is able to be housed axially in the second housing 24*b* of the roll 14.

The projecting portion 26 here is of conical overall shape its cross section decreasing towards the inside of the dispenser 18, and it comprises a plurality of plates 48 or teeth.

Figure 2:
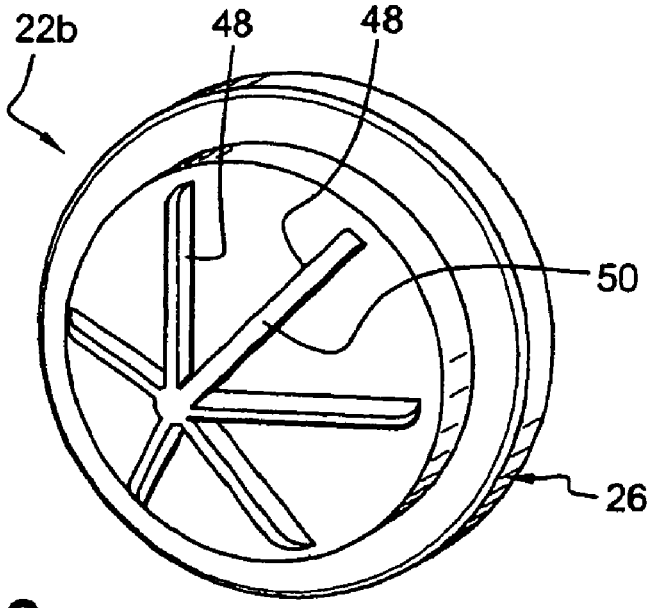
FIG. 2 is a detailed perspective view illustrating a first guiding and positioning element for the roll of FIG. 1.

As illustrated in FIG. 2, the plates 48 are angularly distributed about the axis A uniformly and symmetrically about the axis A, forming a star shape.

Each plate 48 is of a cross section that decreases towards the inside of the dispenser.

In addition, each plate 48 is delimited by a leading edge 50 which is angled towards the axis A and is able to collaborate by sliding on the internal wall 25*b* of the second housing 24*b* of the roll 14.

To this end, the second housing 24*b* has a shape exhibiting symmetry of revolution about the axis A and which complements the shape of the assembly formed by the plates 48, in this instance a conical or frustoconical shape, so as to allow the roll 14 to rotate about the axis A by sliding on the plates 48.

Advantageously, the conical overall shape of the assembly formed by the plates 48 self-centres the roll 14 with respect to the cover 28.

More specifically, the second housing 24*b* has an angle $a_2$ of revolution with respect to the axis A which is substantially identical to an angle $a_1$ of the leading edge 50 of each plate 48 with respect to the axis A.

By way of indication, the optimal angle $a_1$ may range between 30° and 55°.

Advantageously, the second housing 24*b* has a maximum diameter $d_1$ smaller than or equal to one third of the diameter $d_2$ of the new roll 14.

When the cover 28 is in its closed position, each plate 48 extends axially from the first side 16*a* of the roll 14 into the second housing 24*b* of the roll 14 over a length $l_1$ less than or equal to one third of the total axial length $l_2$, or width, of the roll 14.

To encourage the internal wall 25*b* of the second housing 24*b* to slide on the plates 48 as the roll 14 rotates and not to damage the strip of absorbent product 12 of the roll 14 upon contact with the plates 48, the leading edge 50 of each plate 48 is a rounded convex shape with no sharp edges.

Likewise, the plates 48 converge axially towards the axis A to form a vertex 46 of rounded shape with no sharp angles.

Thus, the plates 48 of the projecting portion 26 are able to perform a first function of guiding and positioning the roll 14, if the roll 14 is a so-called complementary roll 14.

The roll 14 depicted in FIGS. 1, 3*a* and 3*b* is a complementary roll 14.

What is meant by a complementary roll 14 is a roll 14 the second housing 24*b* of which has a shape exhibiting symmetry of revolution that complements the shape of the projecting portion 26 and of the plates 48, in this instance a conical overall shape.

According to another aspect, the plates 48 of the projecting portion 26 are able to perform a function of preventing the roll 14 from rotating if the roll 14 is not a complementary roll.

Figure 4:
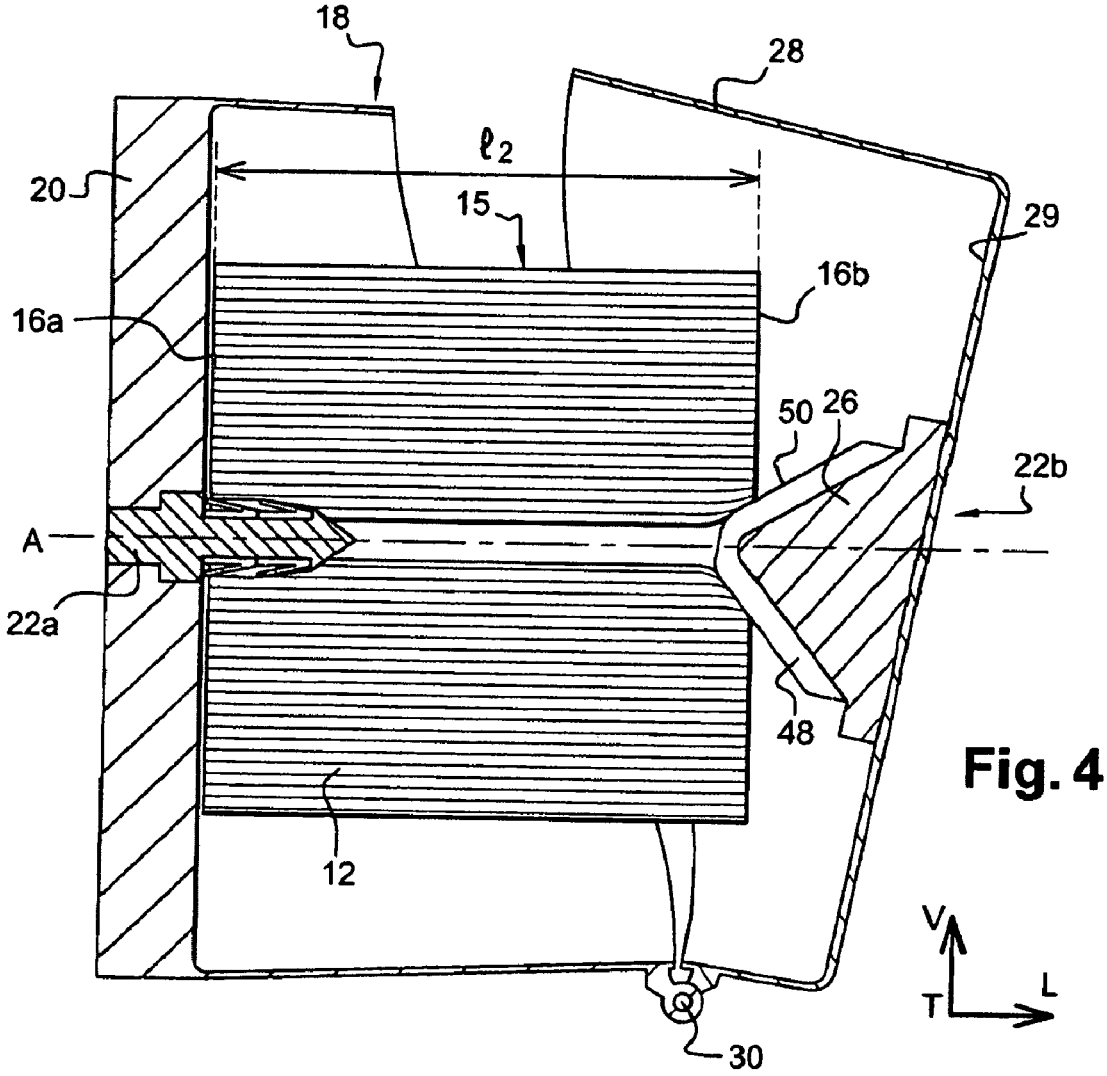
FIG. 4 is a view in longitudinal section of a dispensing system comprising a roll according to the prior art.

What is meant by a roll that is not complementary is a roll 15 the second housing 24*b* of which has a shape that does not complement the shape of the projecting portion 26, like the roll 15 illustrated in FIG. 4.

FIG. 4 illustrates the immobilizing function of the plates 48 of the projecting portion 26.

When the cover 28 is moved into its closed position, the plates 48 of the projecting portion 26 of the second guiding and positioning element 22*b* axially penetrate the side 16*b* of the non-complementary roll 15 partially, thus preventing the cover 28 from closing.

Assuming that the cover 28 were to reach its closed position, the plates 48 would prevent the non-complementary roll 15 from rotating about the axis A, thus ensuring the system 10 is a captive one.

Thus, such a design allows the complementary roll 14 to be arranged and positioned easily in the dispenser 18 while at the same time preventing the strip of product 12 from being dispensed from any non-complementary roll 15.

The invention also relates to a method of manufacturing the complementary roll 14.

The method of manufacturing the complementary roll 14 comprises a step whereby one side of the roll 14, in this instance the second side 16*b*, is axially deformed to form the second housing 24*b*, using a male tool (not depicted) the shape of which is, for example, frustoconical, moved by a machine of the press type, crushing the plies of the paper 12 in the centre of the second side 16*b* of the roll 14 so that the second housing 24*b* is able to collaborate by sliding on the plates 48 of the second guiding and positioning element 22*b*.

By way of indication, the second housing 24*b* thus formed may have a maximum depth $p_1$ equal to one third of the axial length $l_2$ of the complementary roll 14, and preferably equal to one fifth of this length $l_2$ so as not to deform the roll 14 excessively.

For the same reason, the maximum diameter $d_1$ of the second housing 24*b* is less than one half of the diameter $d_2$ of the roll 14 and preferably less than or equal to one third of the diameter $d_2$ of the roll 14.

The conical nature of the second housing 24*b* thus produced does not adversely affect the usage properties of the sheets of paper 12 of which the roll 14 is formed.

According to an alternative form of embodiment, the first holding element 22*a* is of a shape substantially identical to that of the second guiding and positioning element 22*b* possibly with different dimensions.

According to this alternative form of embodiment, the complementary roll 14 has a first housing 24*a* and a second housing 24*b* of conical shape in each of its side 16*a* and 16*b* respectively.

Without departing from the scope of the invention, the means 22 for holding and guiding the rotation of the complementary roll 14 may form part of a structural element not permanently connected to the frame 20 of the dispenser 18.

Figure 5:
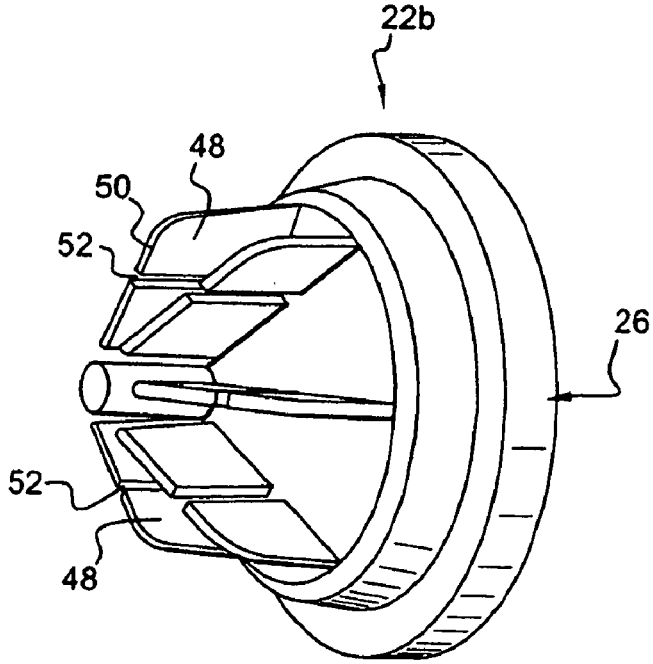
FIG. 5 is a detailed perspective view illustrating the first guiding and positioning element for the roll of FIG. 1, according to an alternative form of the embodiment of the invention.

According to another alternative form of embodiment illustrated in FIG. 5, each plate 48 comprises a plurality of notches 52 each of which extends axially from the leading edge 50 of the associated plate 48.

Thus, if the roll is a non-complementary roll 15, as illustrated in FIG. 4, some of the superposed layers of the strip of absorbent product 12 of a non-complementary roll 15 are trapped in the notches 52 of the plates 48 when the cover 28 is moved into its closed position.

Likewise, in the case of a non-complementary roll that has a core (not depicted), for example a cardboard cylindrical core of axis A, the notches 52 are able to trap the core when the cover 28 is moved into its closed position.

To do that, the notches 52 are arranged in several series. The notches 52 of one and the same series being arranged in a circle about the axis A of rotation of the roll 14 so that each series of notches 52 is capable of trapping a core of determined standard diameter.

Trapping the layers of the strip of product 12 and/or the core makes it difficult to close the cover 28 and/or makes rotating the non-complementary roll practically impossible.

According to the exemplary embodiments described hereinabove, the function of guiding the rotation of the complementary roll 14 and the function of preventing the rotation of the non-complementary roll 15 are performed by the same elements, in this instance the plates 48 of the projecting portion 26.

However, these two functions could be separated, for example the rotational guidance function could be performed by a smooth element against which the internal wall 25*b* of the second housing 24*b* can slide, and the rotation preventing function may be performed by a plurality of projecting elements capable of penetrating the strip of product 12 of the non-complementary roll 15 so as to prevent this roll 15 from turning.

The invention claimed is:

1. System for dispensing a strip of absorbent product in the form of a roll, through rotation of the roll about an axis (A), the system comprising:

a roll, formed of a wound strip of absorbent product rolled up, of substantially cylindrical shape, and axially delimited by a first lateral side and a second axially opposed lateral side;

a dispenser for dispensing the absorbent product in the form of a roll, of the type comprising a frame and a cover which is mounted such that it can move with respect to the frame, between an open position that allows the roll to be fitted inside the dispenser and a closed position for use of the roll;

means for holding and guiding the rotation of the roll with respect to the frame, which means comprise:

a first holding element which is borne by the frame and which is able to be received axially in a first lateral housing arranged in the first side of the roll, and a second guiding and positioning element which is borne by the cover such that the second guiding and positioning element is fixed in terms of rotation and can be received axially in a second lateral housing arranged in the second side of the roll, the second lateral housing comprising a defined shape exhibiting a symmetry of revolution about the axis (A), wherein the second guiding and positioning element comprises a projecting portion comprising a plurality of plates, each plate of the plurality of plates having a shape extending uniformly, radially and axially with respect to the axis (A);

wherein each plate of the plurality of plates comprises an external leading edge at least partially substantially parallel to an internal wall of the second housing;

wherein each plate of the plurality of plates comprises at least one notch in the respective plate which extends substantially parallel to the axis (A) from a leading edge of the respective plate, wherein each notch is interposed between a first plate portion and second plate portion that is coplanar with the first plate portion.

2. The system according to claim 1, wherein the leading edge of each plate of the plurality of plates is of convex shape.

3. The system according to claim 1, wherein each plate of the plurality of plates of the projecting portion further have a shape extending symmetrically about the axis (A) of rotation of the roll with uniform angular spacings.

4. The system according to claim 3, wherein each plate has a cross section that decreases with respect to the radial direction towards the inside of the dispenser so that the leading edge of each plate is angled towards the axis (A) of rotation of the roll.

5. The system according to claim 1, wherein each plate of the plurality of plates of the projecting portion extends about the axis (A) of rotation of the roll with uniform angular spacings.

6. The system according to claim 1, wherein each notch comprises an edge that extends parallel to the axis (A) from a leading edge of the respective plate.

7. The system according to claim 1, wherein each notch comprises two opposing edges that extend parallel to the axis (A) from a leading edge of the respective plate.

* * * * *